United States Patent [19]

Duclos et al.

[11] Patent Number: 4,468,843

[45] Date of Patent: Sep. 4, 1984

[54] COUPLING DEVICE FOR A BELT WITH AUTOMATIC SNAP-LOCKING AND EJECTION

[75] Inventors: Didier A. Duclos, Maisons Alfort; Pierre F. Coutin, Paris, both of France

[73] Assignee: R. Alkan & Cie, France

[21] Appl. No.: 476,664

[22] Filed: Mar. 18, 1983

[30] Foreign Application Priority Data

Mar. 18, 1982 [FR] France ..... 82 04633

[51] Int. Cl.[3] ..... A44B 21/00

[52] U.S. Cl. ..... 24/642; 292/252; 24/635

[58] Field of Search ..... 24/230 R, 230 AK, 230 AL, 24/211 N, 194, 201 TR; 292/252

[56] References Cited

U.S. PATENT DOCUMENTS

| | | | |
|---|---|---|---|
| 2,139,193 | 12/1938 | Lamothe et al. | 292/252 |
| 3,154,272 | 10/1964 | Gold | 24/230 AK |
| 4,071,271 | 1/1978 | Bourrié et al. | 292/252 X |
| 4,100,657 | 7/1978 | Minolla | 24/230 AL |
| 4,149,300 | 4/1979 | Eaton | 24/230 AL |

FOREIGN PATENT DOCUMENTS

| | | | |
|---|---|---|---|
| 2341601 | 2/1975 | Fed. Rep. of Germany | 24/230 AL |
| 2915246 | 10/1979 | Fed. Rep. of Germany | 24/230 AL |

*Primary Examiner*—William E. Lyddane
*Assistant Examiner*—Peter A. Aschenbrenner
*Attorney, Agent, or Firm*—William A. Drucker

[57] ABSTRACT

A device is provided formed by a case which contains, on each side of a ball for retaining the coupling member of the belt, two spring-loaded sliding keys cooperating alternately with the ball so that the retreat of one against the action of its spring allows the automatic advance of the other one either for locking said ball in the coupling member of said belt during penetration of this member into the case, or for releasing said coupling member and automatically ejecting same, depending on the key which is moved back against the action of its spring.

4 Claims, 4 Drawing Figures

COUPLING DEVICE FOR A BELT WITH AUTOMATIC SNAP-LOCKING AND EJECTION

BACKGROUND OF THE INVENTION

Numerous devices are known for coupling and releasing, with ejection, different loads. The device forming the subject of the present invention relates more particularly to coupling and releasing a belt buckle equipping aircraft seats or a safety belt buckle for motor vehicles. The aim of the invention is to provide a device which is reliable in operation and which provides automatic snap-locking of the buckle whereas release of this buckle causes ejection thereof.

SUMMARY OF THE INVENTION

This device is characterized by its extreme simplicity for it is formed from a case containing a ball and two spring-loaded sliding keys, that is to say only four main parts as will be explained hereafter in the description of one embodiment made with reference to the accompanying drawings.

DESCRIPTION OF THE PREFERRED EMBODIMENT

Figure 1:
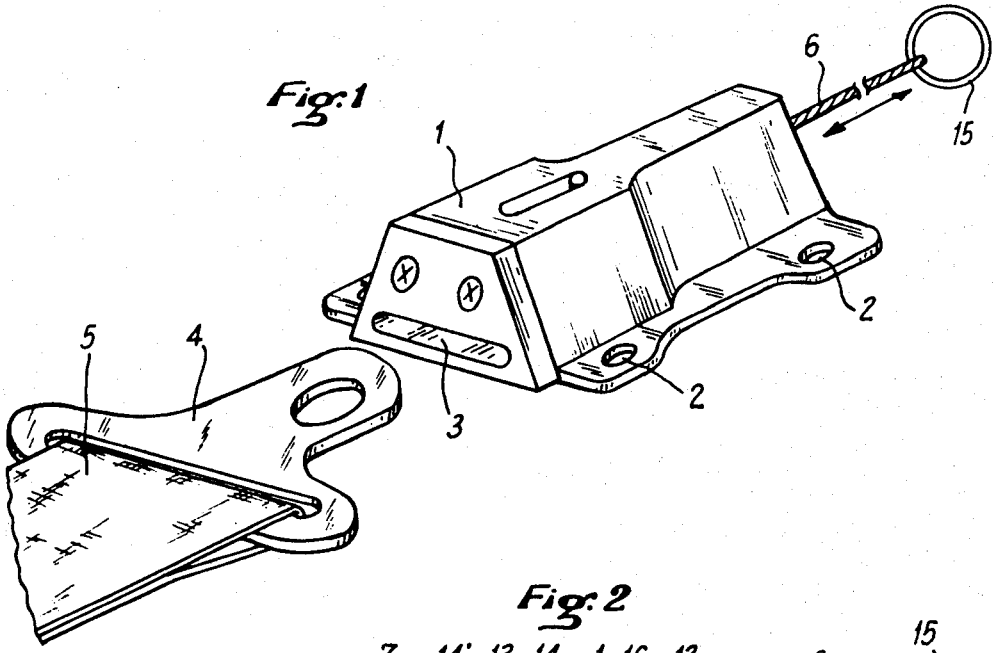
FIG. 1 shows a perspective view of the external shape of the device.

In FIG. 1 there is shown at 1 the case of the device with at 2 the fixing points thereof, and at 3 the opening in the shape of a wide-mouthed slit for introducing the buckle 4 integral with belt 5. At 6 is shown a tripping device which, when pulled, causes the automatic ejection of the buckle.

In FIG. 2, we find again at 1 the case, at 3 the opening through which passes the buckle 4 shown in the removed position, that is to say either ready to be introduced, or ejected after operation of the device. At 7 there is shown a ball held in position by the sliding key 8 urged by spring 9. This key is preferably cylindrical and has a flat portion 10 intended to move in the coupling opening 3. Key 8 and its spring are situated in a small cylindrical bore 11 formed in the lower part of case 1. Above this bore 11 is provided a second bore 12 parallel to the first one. In this bore 12 there slides a second cylindrical key 13 also comprising a flat portion 14 with a chamfer 14'. It will be readily understood that flat portions 10 and 14 are intended to act alternately on each side of ball 7 either for moving the ball away from entrance 3 while ensuring ejection of the buckle or allowing introduction thereof, or for bringing the ball back towards the base of the case while ensuring snap-locking thereof in the recess formed for this purpose in buckle 4.

Figure 2:
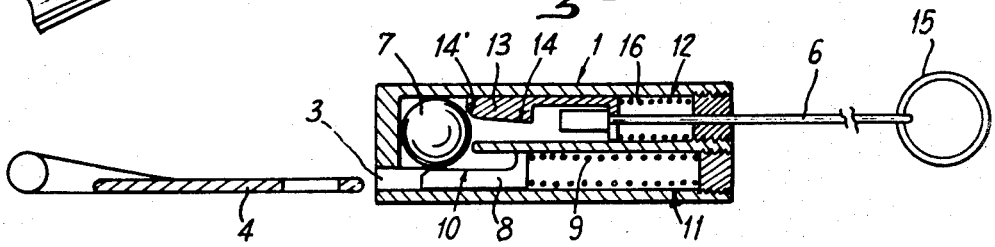
FIG. 2 shows a longitudinal section of the device in the waiting position.

For actuating key 13, there is shown by way of example a pull-string 6 having a ring 15 outside case 1 so that a pull exerted on the ring in a direction opposite entrance 3 draws back the key against the action of its spring and allows the ball to rise to its position shown in FIG. 2 while freeing the entrance 3.

Figure 3:
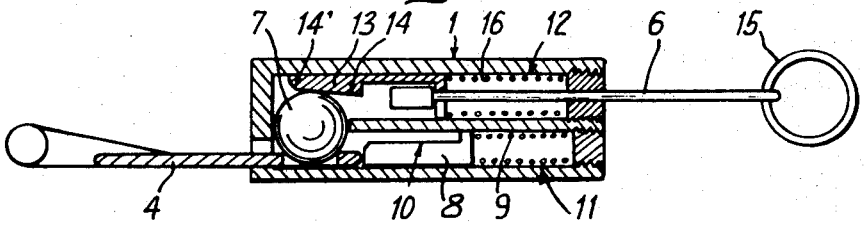
FIG. 3 is the same longitudinal section showing the belt buckle clipped in the device.

In FIG. 3, the same parts as those in FIG. 2 are shown but in the relative positions which they occupy after buckle 4 has been introduced into case 1, this introduction pushing back key 8 and allowing snap-locking of the ball under the advancing action of key 13.

Figure 4:
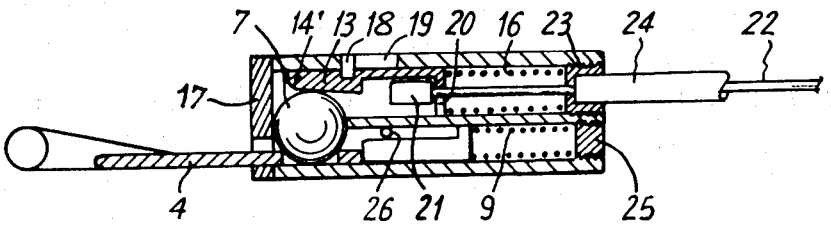
FIG. 4 is a more detailed sectional view showing by way of example one practical embodiment of the device with the removable parts allowing the different internal parts thereof to be assembled.

In FIG. 4, the main parts appearing in the other figures are shown again with the same references. There is in addition shown at 17 a removable element for fitting ball 7 into case 1 during assembly thereof. This element 17 may for example be a simple plate fixed on the end of the case by two screws. A finger 18 of small diameter is screwed into key 13 and projects into a longitudinal slit 19 formed in case 1. This finger has a double purpose, on the one hand it prevents the cylindrical key 13 from rotating on itself and, on the other hand, it allows the correct locking position of this same key 13 to be verified. At 20 there is shown a notch formed in key 13 for housing therein, should a sheathed cable be used, part 21 crimped on cable 22 with the required clearance depending on the conditions of use. The end 23 of the sheath 24 is screwed into the case 1 and serves as a seat for spring 16. At 25 there is shown a plug also screwed into case 1 and serving as a seat for spring 9. Finally, there is shown at 26 a fixed pin limiting the ejection travel of key 8 and also preventing this key from rotating on itself.

The operation of the device is clear from the preceding description and may be summed up as indicated hereafter. For snap-locking, from the position shown in FIG. 2, buckle 4 is fitted into cases 1 through slot 3 while pushing back key 8 against its spring 9 so as to move it from the position shown in FIG. 2 to the position shown in FIG. 3. Ball 7 then engages in the hole of buckle 4 under the action of key 13 urged by its spring 16, the flat portion 14 coming into engagement above ball 7. Removal of the buckle is then impossible, except by causing key 13 to move back by operating the pull-cord 6 or its equivalent against spring 16.

The rearward movement of key 13 may be facilitated by giving a slope to flat portion 14 so that the reaction of ball 7 has a favorable component. That allows the device to be unlocked without excessive effort despite the pull exerted on the buckle by the tension of the belt. The device then abruptly takes on the configuration shown in FIG. 2, key 8 under the action of spring 9 ejecting buckle 4 while pushing ball 7 upwardly simultaneously. Flat portion 10 then comes back to the position which it occupies in FIG. 2. With pull-card 6 released, key 13 also takes up again the position shown in FIG. 2, its travel being limited by the presence of ball 7. The device then assumes automatically its initial configuration.

It will be readily understood that several devices may be controlled by acting simultaneously or not on several pull-cords. These pull-cords may obviously be controlled at a distance by known procedures, such as those using electromagnets, pyrotechnics or others.

What we claim is:

1. A coupling device for a belt with automatic snap-locking and ejection, which comprises:

(a) a case;

(b) two parallel guiding passages provided within said case;

(c) a free space provided between a front end-wall of the case and one end of said guiding passages;

(d) a snap-locking ball disposed with play within said free space;

(e) a locking element movable axially within a first of said guiding passages and presenting a forward portion engagable with said ball to move said ball transversely in relation to the longitudinal axis of said first guiding passage;

(f) a first spring disposed within said first guiding passage and urging said locking element toward a position in which said locking element engages said ball;

(g) a traction member rigid with said locking element and passing through a rear end-wall of said case to control a retraction of the locking element against the action of said first spring;

(h) an opening provided in the front end-wall of said case, in front of a second of said two guiding passages, said opening allowing introduction in said free space of said case a bored portion of a belt buckle engagable by said ball;

(f) a second spring disposed within said second guiding passage and bearing on a rear end-wall of said case, and (j) an ejector disposed within said second guiding passage and having a rear portion engaging said second spring and a front portion of reduced height, said ejector sliding axially within said second guiding passage between a first position in which it does not engage said ball and compresses said second spring under the action of the belt buckle introduced into said case opening, and a second position corresponding to the ejection of the belt buckle in which the portion of reduced height of the ejector engages said ball to urge it transversely toward said locking element, thus allowing a next introducing of the belt buckle into the case opening, so that when introducing the belt buckle into the case opening the ejector is pushed rearwardly against the action of said second spring while said ball actuated by the spring-biased locking element moves within said free space to engage the bored portion of the belt buckle and to lock same, a pulling action exerted on said traction member freeing said ball from the locking element action and causing the ball to move under the action of the spring-biased ejector to release the bored-portion of the belt buckle which is then ejected from the case opening, said ball being maintained in this release position by the ejector to allow a next introducing of the belt buckle into the case opening.

2. A coupling device according to claim 1 wherein said traction member comprises a cable having one end connected to said locking element and which extends outside of the case, into a sheath connected to the rear end-wall of the case, while its other end is connected to a remote control member.

3. A coupling device according to claim 1 wherein a finger is rigid with said locking element and is slidable along a longitudinal slit provided in the case, said finger preventing said locking element from rotating on itself and allowing to check the correct locking position of said locking element.

4. A combination of several coupling devices for belts according to claim 2 associated together wherein the ends of the sheathed cables are connected together for allowing a simultaneous control of the coupling devices of the belts.

* * * * *